US009932987B2

(12) United States Patent
Engländer

(10) Patent No.: US 9,932,987 B2
(45) Date of Patent: Apr. 3, 2018

(54) ROTOR DISC AND ROTOR FOR A VACUUM PUMP

(71) Applicant: Oerlikon Leybold Vacuum GmbH, Cologne (DE)

(72) Inventor: Heinrich Engländer, Linnich (DE)

(73) Assignee: LEYBOLD GMBH, Köln (DE)

( * ) Notice: Subject to any disclaimer, the term of this patent is extended or adjusted under 35 U.S.C. 154(b) by 0 days.

(21) Appl. No.: 15/039,183

(22) PCT Filed: Oct. 28, 2014

(86) PCT No.: PCT/EP2014/073143

§ 371 (c)(1),
(2) Date: May 25, 2016

(87) PCT Pub. No.: WO2015/078648

PCT Pub. Date: Jun. 4, 2015

(65) Prior Publication Data

US 2017/0023002 A1 Jan. 26, 2017

(30) Foreign Application Priority Data

Nov. 30, 2013 (DE) ..... 20 2013 010 937 U

(51) Int. Cl.
*F04D 29/32* (2006.01)
*F04D 19/04* (2006.01)
(Continued)

(52) U.S. Cl.
CPC ..... *F04D 29/324* (2013.01); *F04D 19/042* (2013.01); *F04D 29/023* (2013.01); *F04D 29/321* (2013.01); *F04D 29/668* (2013.01)

(58) Field of Classification Search
CPC .... F04D 29/324; F04D 29/668; F04D 29/023; F04D 29/321; F04D 19/042
See application file for complete search history.

(56) References Cited

U.S. PATENT DOCUMENTS 4,702,671 A 10/1987 Brinkman et al.
7,153,098 B2 12/2006 Zabawa
(Continued)

FOREIGN PATENT DOCUMENTS

DE 102007048703 A1 4/2009
JP 59113990 A 6/1984
(Continued)

OTHER PUBLICATIONS

Japanese Office Action dated Nov. 1, 2016 for Japanese application No. 2016-535141.
(Continued)

*Primary Examiner* — Woody Lee, Jr.
*Assistant Examiner* — Maxime Adjagbe
(74) *Attorney, Agent, or Firm* — Ohlandt, Greeley, Ruggiero & Perle, LLP

(57) ABSTRACT

A rotor disc for a vacuum pump, in particular a turbo molecular pump, having an inner ring. The inner ring is connected to a plurality of blade elements extending radially outward. The inner ring has at least one expansion joint. For assembly, the inner ring can be surrounded by a retaining ring and arranged on a hollow cylindrical carrier element as applicable.

21 Claims, 2 Drawing Sheets

(51) Int. Cl.
*F04D 29/02* (2006.01)
*F04D 29/66* (2006.01)

(56) References Cited

U.S. PATENT DOCUMENTS

| | | | | |
|---|---|---|---|---|
| 8,562,293 | B2 | 10/2013 | Engländer | |
| 2001/0048876 | A1 | 12/2001 | Humhauser | |
| 2003/0194319 | A1 | 10/2003 | Zabawa | |
| 2010/0290915 | A1 | 11/2010 | Englaender | |
| 2012/0230829 | A1 | 9/2012 | Benkler et al. | |
| 2014/0037488 | A1* | 2/2014 | Glen | F04C 18/00 418/160 |

FOREIGN PATENT DOCUMENTS

| | | | |
|---|---|---|---|
| JP | 60234777 | A | 11/1985 |
| JP | 2003314206 | A | 11/2003 |
| JP | 2011501010 | A | 1/2011 |
| JP | 5106588 | B2 | 12/2012 |
| JP | 2013510994 | A | 3/2013 |
| WO | 2009049988 | A1 | 4/2009 |
| WO | 2011061192 | A1 | 5/2011 |

OTHER PUBLICATIONS

International Search Report dated Dec. 23, 2014 for PCT application No. PCT/EP2014/073143.

* cited by examiner

ROTOR DISC AND ROTOR FOR A VACUUM PUMP

BACKGROUND

1. Field of the Disclosure

The disclosure relates to a rotor disc for a vacuum pump, in particular a turbomolecular pump, as well as to a rotor comprising such rotor discs.

2. Discussion of the Background Art

Vacuum pumps, such as in particular turbomolecular vacuum pumps, have a rotor shaft supported in a pump housing. The rotor shaft which is driven in particular by an electric motor carries a rotor surrounded by a stator arranged in the pump housing. In particular turbomolecular pumps comprise a plurality of rotor discs. The individual rotor discs comprise a plurality of rotor blades. Stator discs of the stator surrounding the rotor are respectively arranged between adjacent rotor discs, the stator discs also having stator blades.

It is known to produce the rotor of a turbomolecular pump as a single piece. In this regard, the individual rotor discs are manufactured from a solid block, in particular by milling. This is an extremely tedious and expensive method. With such rotors, the stator discs are most often of a two-part design so that they can be inserted between two adjacent rotor discs from outside.

It is further known from DE 10 2007 048 703 to assemble a rotor for a turbomolecular pump from individual rotor discs. In this case, the individual rotor discs are connected with each other via reinforcement rings, each disc having in particular a plane of rotor vanes. The reinforcement rings respectively surround an inner ring of the rotor disc. A rotor of a vacuum pump built from a plurality of rotor discs is manufactured using mechanical joining methods. For this purpose, the inner ring of the rotor disc is oversized with respect to the reinforcement ring. Joining is performed by heating or cooling the components to be joined and by subsequent pressing. This is disadvantageous in that the joining process introduces tensions into the inner ring or the hub of the rotor disc. Further tensions occur due to the great centrifugal forces, as well as to the different thermal expansions of the rotor disc and the reinforcement ring during operation.

It is an object of the present disclosure to provide a rotor disc and a rotor having a plurality of rotors discs, wherein the occurrence of tensions is reduced, in particular at the inner ring of the rotor disc.

SUMMARY

The present rotor disc for a vacuum pump and in particular for a turbomolecular pump comprises a preferably substantially cylindrical inner ring. The same is connected and in particular integrally formed with radially outward extending blade elements. According to the disclosure the inner ring has at least one expansion joint or a slot. Providing such an expansion joint is advantageous in that thermal expansions can be compensated thereby. Due to the slot being provided, the occurrence of tangential tensions is reduced or possibly even avoided altogether. By providing an expansion joint according to the present disclosure, the occurrence of tangential tensions is at least significantly reduced in particular in the outer region of the inner ring, i.e. in particular at the transitions between the inner ring and the blade elements. Thereby, it is preferably possible to operate a rotor built from such rotor discs at higher rotational speeds.

The expansion joint or the slot preferably extends in parallel with the blades over the entire width of the inner ring. Thus, the inner ring of the rotor disc is entirely slotted. It is particularly preferred that the slot or the expansion joint is slanted. In particular the slant is such that any damage to the blade elements by the slot is avoided. In a particularly preferred embodiment the expansion joint or the slot is thus arranged slanted and in particular has the same inclination as the blade. When the inclination of the blade changes, the relevant aspect is the inclination of the blade in the region of the blade base, i.e. in the transition region of the connection of the blade elements with the inner ring.

In a preferred development of the rotor disc of the present disclosure it is also possible to provide a plurality of expansion joints or a plurality of slots. Preferably, the expansion joints are regularly distributed over the circumference of the inner ring. Here, the individual inner ring segments may possibly carry only one blade element so that an inner ring is provided that is assembled from a plurality of inner ring segments. The individual inner ring segments may be connected with each other by connecting elements. For example, connecting elements made of an elastomer may be provided in the slots or the expansion joints. Moreover, it is possible to connect the individual inner ring segments while assembling them into a rotor. Due to the segmentation of the inner ring, the tendency to an unbalance caused by a one-sided expansion is reduced or suppressed. Further, providing a plurality of a plurality of expansion joints regularly distributed over the circumference is advantageous in that the tensions are compensated better and the deformation of individual segments is respectively less than the deformation of a whole ring segment having only one slot.

In a further particularly preferred embodiment of the rotor disc according to the present disclosure the blade elements are tapered in the region of the blade base, i.e. in the transition region between the blade elements and the inner ring. The taper is formed in particular by recesses provided both in the upper and the lower side. These recesses are preferably formed to be mirror-symmetric so as to avoid unbalances. Thus, the recesses are mirror-symmetric with respect to a centre line of the blade elements or to a central plane of the blades. Providing a tapering of the blade elements in the region of the blade base has positive effects on possibly occurring vibrations of the blade elements. This is advantageous in particular in the mounted state.

The disclosure further refers to a rotor for a vacuum pump, in particular a turbomolecular pump. The rotor has a plurality of rotor discs arranged in the longitudinal direction of the rotor or in the longitudinal direction of a rotor shaft, the discs preferably being designed as described above.

Preferably, the at least one inner ring is surrounded by a retaining ring for fixation. In particular the retaining ring is a reinforcement ring preferably made of fiber-reinforced plastic material such as CFC. Preferably the retaining rings are designed and arranged at least in part such that a respective retaining ring surrounds two adjacent inner rings of the rotor discs. In this regard, the retaining ring at least partly surrounds two adjacent inner rings in the longitudinal direction. In a preferred embodiment an inner ring is thus fixed in particular by two retaining rings. The retaining rings each project in part over the inner ring. In particular a part of the inner ring is not surrounded by a retaining ring in the longitudinal direction, the blade elements in this region of the inner ring being connected, in particular integrally formed with the inner ring.

In the preferred development of the rotor disc in which the blade elements are tapered at the blade base, providing the retaining ring may effect damping. Depending on the operating state, the blade elements are possibly caused to vibrate. These vibrations may be reduced by the retaining ring. In this embodiment the retaining ring thus has the additional function of a damper.

It is particularly preferred that the retaining ring covers the recesses forming the taper. Thus, a part of the retaining ring contacts the upper or the lower side of the blade elements. A good damping of vibrations of the blade elements may thereby be achieved. In this embodiment it is particularly preferred that the retaining rings contain fiber-reinforced plastics, it being particularly preferred to design the retaining rings as CFC tubes.

In another preferred embodiment of the disclosure in which the inner rings are of a multi-part design, a tensioning element is preferably provided inside the inner ring. The tensioning element presses the individual inner ring segments against the retaining ring so that a defined position of the inner ring segments is guaranteed.

It is possible that the inner rings for a self-supporting structure in connection with the retaining rings and possibly with the tensioning elements. It is preferred to additionally provide a supporting element inside the inner rings. The supporting element may be the rotor shaft itself or an element to be connected with the rotor shaft. Such an element to be connected with the rotor shaft is preferably designed as a hollow cylinder so that the rotor shaft protrudes at least in part into the hollow cylinder, in which case the hollow cylinder carries the inner rings.

In a preferred development the supporting element which is designed in particular as a hollow cylinder comprises a preferably annular retaining protrusion directed radially outward. Due to this also step-shaped retaining protrusion in particular the position of a—seen in the longitudinal direction—outer inner ring and/or a—seen in the longitudinal direction—outer retaining ring is defined.

Further, the in particular hollow cylindrical supporting element may have an opening in the longitudinal direction which is closed at least in part by cover element. The cover element may also serve to fix an outer inner ring and/or an outer retaining ring. The cover element may have a step-shaped, radially outward directed protrusion. The cover element specifically serves for a positionally accurate fixation of the inner rings and the retaining rings on the supporting element.

For the assembly of an inner ring having an expansion joint it is possible to slightly compress the same and to insert the ring into the retaining ring so that the inner rings are fixed in the retaining ring by their inherent tension. With multi-part inner rings, the individual inner ring segments are pressed against an inner side of the retaining rings by means of a tensioning element.

The following is a detailed explanation of the disclosure with reference to preferred embodiments and to the accompanying drawings.

DETAILED DESCRIPTION OF THE PREFERRED EMBODIMENT

Figure 1:
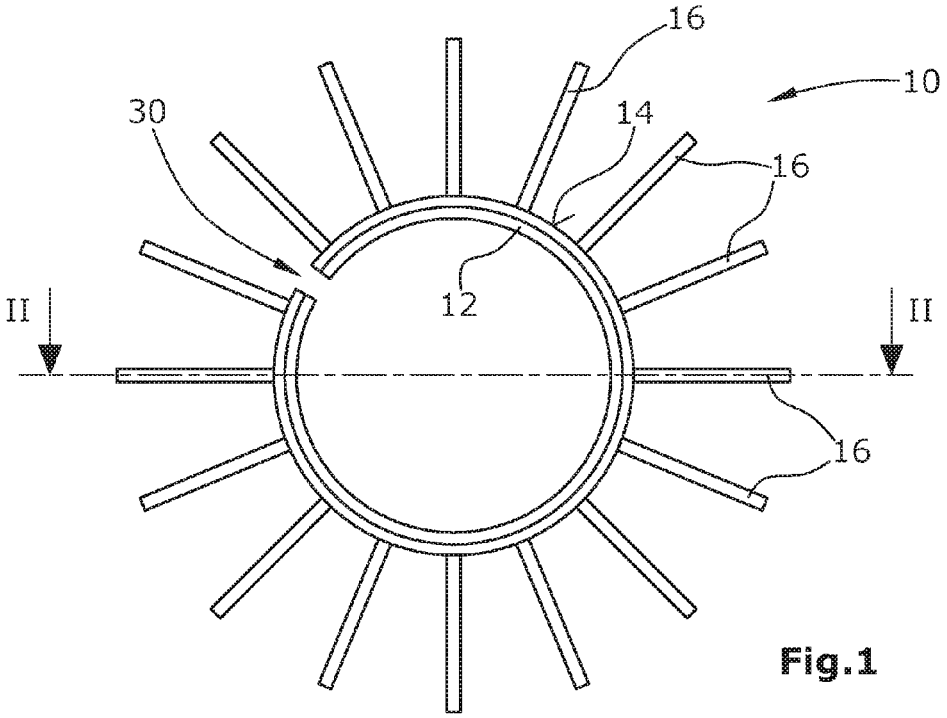
FIG. 1 shows a schematic top plan view of a rotor disc.

A rotor disc 10 of the present disclosure comprises an inner ring 12 having a plurality of blade elements 16 arranged on the outer side 14 thereof in a manner regularly distributed over the circumference. The blade elements 16 are connected with the inner ring 12 in particular integrally. In sectional view (FIG. 2), the inner ring 12 has two substantially cylindrical ring elements 18, the blade elements 16 being respectively connected with the ring element 12 between the two ring elements 18.

Figure 2:
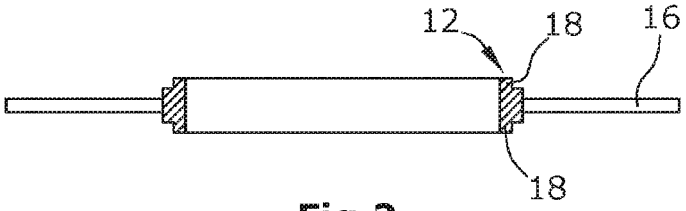
FIG. 2 is a schematic sectional view of the rotor disc illustrated in FIG. 1 in the direction of the arrows II-II in FIG. 1.

In a first preferred embodiment of a rotor (FIG. 3) a plurality of the rotor discs illustrated in FIGS. 1 and 2 is arranged in the longitudinal direction 20 on a supporting element 22. In the embodiment illustrated the supporting element 22 is hollow cylindrical so that the same can be plugged and fixed on a rotor shaft not illustrated herein.

Figure 3:
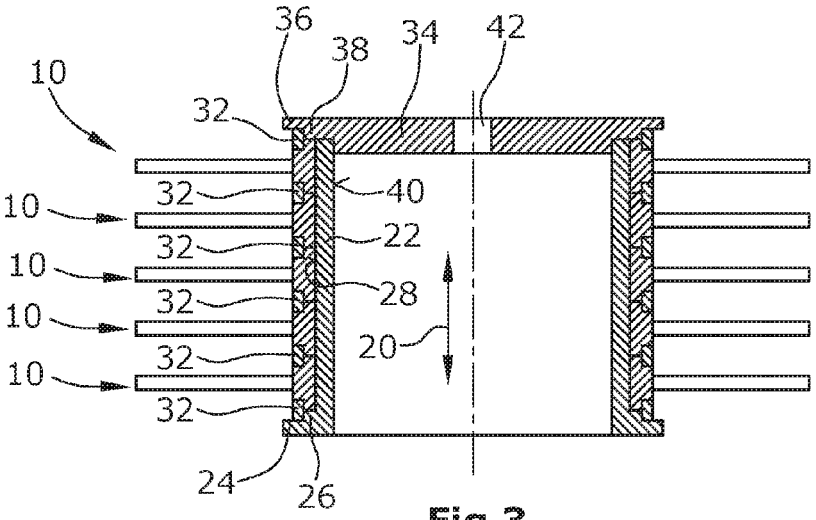
FIG. 3 is a schematic sectional view of a rotor having a plurality of the rotor discs illustrated in FIGS. 1 and 2.

A its lower end in FIG. 3 the supporting element 22 has a stepped retaining protrusion 24 with a step 26. Seen in the longitudinal direction 22, five rotor discs 10 are arranged in the longitudinal direction on an outer side 28 of the supporting element in the embodiment illustrated. The rotor discs 10 each have slot or an expansion joint 30 (FIG. 1). In the mounted state, the inner rings 12 of the rotor discs 10 are surrounded by retaining or reinforcement rings 32. For assembly, the inner rings 10 having a slot 30 are compressed and set into the retaining rings 32 which are designed as closed rings. Each retaining ring 32 surrounds two ring elements 18 of two adjacent inner rings 12 with the exception of the two outer inner rings 12. The lower retaining ring in FIG. 3 surrounds both the ring element 18 of the lower inner ring 12 and the step 26 of the retaining protrusion 24 of the supporting element 22.

The possible pre-assembled rotor discs 10, together with the retaining rings 32, may be plugged onto the supporting elements 22 from above in FIG. 3. In this case, stator discs arranged between the rotor discs 10 may be designed as closed rings and are arranged between the latter already during assembly of the rotor discs. It is also possible that the stator discs are two-part stator discs, for example, which are inserted between two adjacent rotor discs 10 from outside after the rotor is fully assembled.

The upper rotor disc 10 in FIG. 3 is connected with a cover element 34 via an upper retaining ring. For this purpose the cover element 34 has a retaining projection 36 which in the embodiment illustrated also has a step 38.

The upper retaining ring 32 thus contacts the ring element 18 of the upper inner ring 12 and the step 38 of the retaining projection 36 of the cover element 34. The cover 34 is set into an opening 40 of the hollow cylindrical supporting element 22. In the embodiment illustrated the cover 34 has a bore 42. Through the same the rotor may be fixed, e.g. by a screw, to a front end of a rotor shaft inserted into the supporting element 22.

In operation only the forces of one rotor disc act on the upper retaining ring 32 in FIG. 3 and the lower retaining ring in FIG. 3. It may therefore possibly be suitable to give these retaining rings another design in order to avoid in particular a tilting of the rotor discs 10 caused by the tensions and loads occurring. This could, for example, be effected by reducing, in particular halving the width of the upper retaining ring 32 and the lower retaining ring 32.

Figure 4:
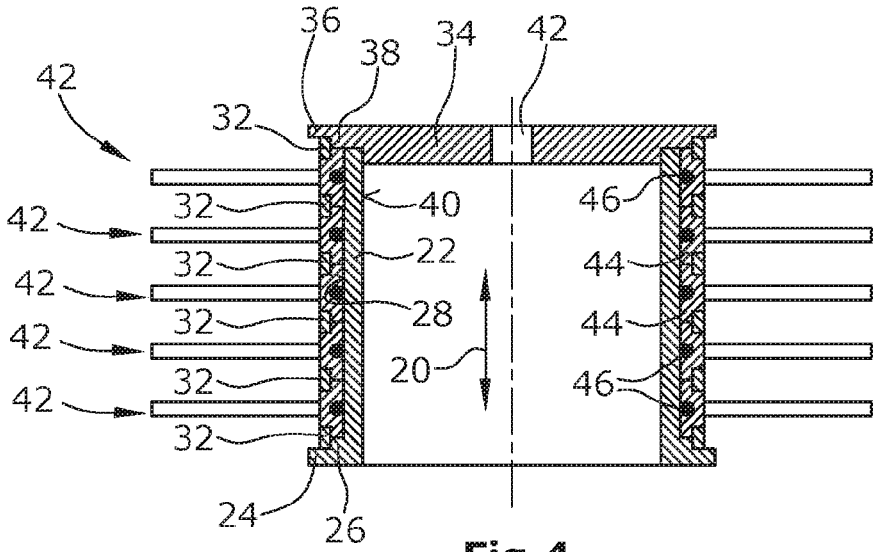
FIG. 4 is a schematic sectional view of a further preferred embodiment of a rotor having a plurality of inner ring segments.

In the further preferred embodiment of the rotor according to the present disclosure illustrated in FIG. 4 similar or identical components are identified by the same reference numerals.

This embodiment has the essential difference that the rotor discs not only have one slot 30, but a plurality of slots so that individual rotor segments or inner ring segments are provided. In the assembled form the individual rotor segments 42 again form a rotor disc which corresponds in function to the rotor disc 10. In order to guarantee a secure arrangement of the inner ring segments of the rotor disc segments 42, a recess is provided in the inner side of the inner ring segments 44, in which recess a tensioning element 46 is arranged. The tensioning element is in particular annular in shape. For the rest, the assembly and the arrangement of the individual elements corresponds to the embodiment described with reference to FIG. 3.

Figure 5:
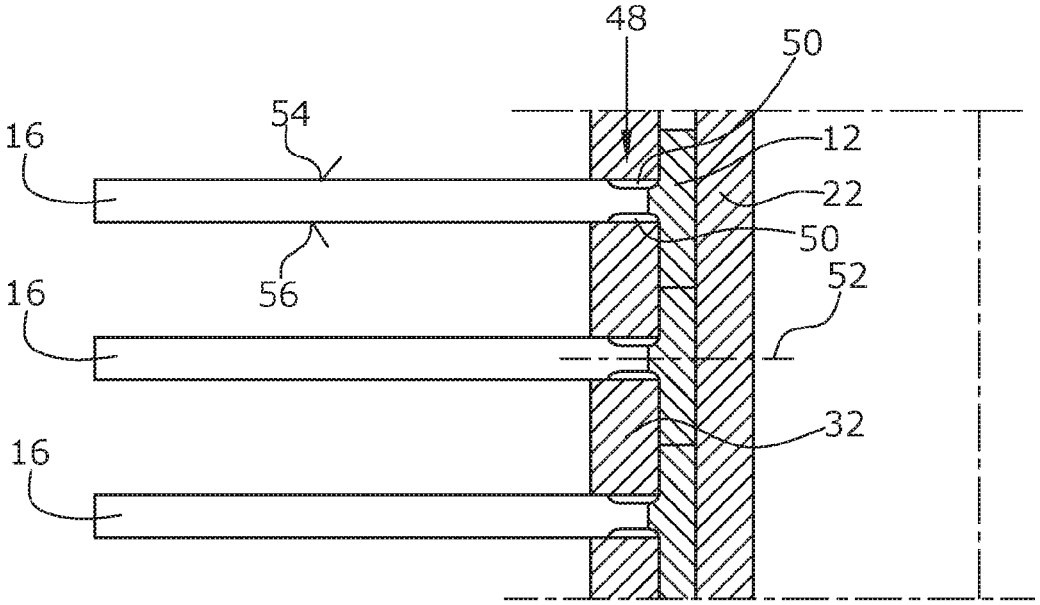
FIG. 5 is an enlarged sectional view of a detail of another preferred embodiment of a rotor constructed according to the disclosure.

In the further embodiment illustrated in FIG. 5 similar or identical components are identified by the same reference numerals. The essential difference of this embodiment is in the design of the rotor discs. Again, these have an inner ring 12 connected with the blade elements 16. Instead of the inner ring 12, an inner ring may be provided that corresponds to the design of the inner ring 44 (FIG. 4). In the region of a blade base 48, i.e. in the transition region between the inner ring 12 and the blade element 16, a taper is provided. In the embodiment illustrated the same is formed on each blade element 16 by two opposite recesses 50. The recesses 50 are formed as circumferential annular trough-shaped recesses. The recesses 50 are designed to be mirror-symmetric to a centre line 52 of the blade element 16.

The radial width of the retaining rings 32, which in particular are CFC tubes, is selected such that the retaining rings 32 fully cover the recesses 50. In particular, the retaining rings 32 contact an upper side 54 and a lower side 56 of the blade elements. This contact preferably extends over several millimeters. Due to the contact of the retaining rings 32 on the upper side 54 and the lower side 56 of the blade elements 16, the retaining rings 32 additionally act as damping elements.

The assembly of the embodiment illustrated in FIG. 5 corresponds to the assembly described with respect to FIG. 3.

The invention claimed is:

1. A rotor disc for a vacuum pump, comprising:

an inner ring; and a plurality of turbomolecular pump blade elements extending radially outward and being connected with the inner ring, wherein the inner ring has at least one expansion joint that is a slot.

2. The rotor disc of claim 1, wherein the at least one expansion joint extends over an entire width of the inner ring.

3. The rotor disc of claim 1, further comprising a plurality of expansion joints provided regularly distributed over a circumference of the inner ring.

4. The rotor disc of claim 1, wherein the plurality of blade elements are tapered at a base of each blade element.

5. The rotor disc of claim 4, wherein, for tapering, the plurality of blade elements have a recess in an upper side and a lower side.

6. A rotor for a vacuum pump, comprising a plurality of the rotor discs of claim 1 arranged in a longitudinal direction of the rotor.

7. The rotor of claim 6, further comprising at least one retaining ring surrounding the inner ring in order to fix the inner ring.

8. The rotor of claim 7, wherein the at least one retaining ring surrounds the inner ring of two adjacent rotor discs.

9. The rotor of claim 7, wherein the at least one retaining ring covers a taper provided at a base of each blade element of the plurality of blade elements.

10. The rotor of claim 7, wherein the at least one retaining ring contacts an upper side and a lower side of the plurality of blade elements for the purpose of damping vibrations.

11. The rotor of claim 7, wherein the at least one retaining ring comprises fiber-reinforced plastics.

12. The rotor of claim 6, further comprising a tensioning element inside the inner ring.

13. The rotor of claim 6, further comprising a supporting element that carries the inner ring.

14. The rotor of claim 13, wherein the supporting element is a hollow cylinder.

15. The rotor of claim 13, wherein the supporting element is directed radially outward.

16. The rotor of claim 13, wherein the supporting element has an opening that is closed, at least in part, by a cover element, the cover element fixing the inner ring against a retaining projection of the supporting element.

17. The rotor disc of claim 2, wherein the at least one expansion joint extends obliquely corresponding to a blade inclination.

18. The rotor disc of claim 5, wherein the recess in the upper and lower sides are mirror-symmetric.

19. The rotor of claim 11, wherein the at least one retaining ring is a CFC tube.

20. The rotor of claim 15, wherein the supporting element comprises an annular retaining protrusion that is directed radially outward.

21. The rotor of claim 13, further comprising at least one retaining ring surrounding the inner ring in order to fix the inner ring, wherein the supporting element has an opening that is closed, at least in part, by a cover element, the cover element fixing the at least one retaining ring.

* * * * *